US010899680B2

(12) United States Patent
Löhken et al.

(10) Patent No.: US 10,899,680 B2
(45) Date of Patent: Jan. 26, 2021

(54) HIGH TEMPERATURE INITIATOR

(71) Applicant: DynaEnergetics GmbH & Co. KG, Troisdorf (DE)

(72) Inventors: Jörn Olaf Löhken, Troisdorf (DE); Liam McNelis, Bonn (DE); Jörg Müller, Bonn-Lengsdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 158 days.

(21) Appl. No.: 16/092,371

(22) PCT Filed: Mar. 2, 2017

(86) PCT No.: PCT/EP2017/054965
§ 371 (c)(1),
(2) Date: Oct. 9, 2018

(87) PCT Pub. No.: WO2017/194219
PCT Pub. Date: Nov. 16, 2017

(65) Prior Publication Data

US 2019/0127290 A1 May 2, 2019

Related U.S. Application Data

(60) Provisional application No. 62/398,587, filed on Sep. 23, 2016, provisional application No. 62/333,760, filed on May 9, 2016.

(51) Int. Cl.
*C06B 25/34* (2006.01)
*C06C 7/00* (2006.01)
(Continued)

(52) U.S. Cl.
CPC ..... *C06C 7/00* (2013.01); *C06B 41/00* (2013.01); *E21B 43/119* (2013.01); *F42B 3/12* (2013.01)

(58) Field of Classification Search
USPC ..... 149/88, 92, 108.6, 109.4
See application file for complete search history.

(56) References Cited

U.S. PATENT DOCUMENTS 4,632,034 A * 12/1986 Colle, Jr. ..... E21B 43/116 102/312
8,092,623 B1 * 1/2012 Cramer ..... C06B 33/00 149/37
(Continued)

FOREIGN PATENT DOCUMENTS

CN 1228752 A 9/1999
CN 101466653 A 6/2009
(Continued)

OTHER PUBLICATIONS

International Search Report and Written Opinion of International App. No. PCT/EP2017/054965, dated May 15, 2017, 17 pgs.
(Continued)

*Primary Examiner* — James E McDonough
(74) *Attorney, Agent, or Firm* — Moyles IP, LLC

(57) ABSTRACT

According to an aspect, the present embodiments may be associated with a device and method of using an initiator including a body configured for receiving at least one explosive including barium 5-nitriminotetrazolate (BAX). According to a further aspect, the body of the initiator is configured for receiving at least two layers of explosive. In this embodiment, the layers of explosive include a primary explosive of the barium 5-nitriminotetrazolate (BAX) and a secondary explosive includes 2,6-Bis(picrylamino)-3,5-dinitropyridine (PYX) and/or Hexanitrostilbene (HNS).

20 Claims, 7 Drawing Sheets

(51) Int. Cl.

| | |
|---|---|
| ***C06B 41/00*** | (2006.01) |
| ***E21B 43/119*** | (2006.01) |
| ***F42B 3/12*** | (2006.01) |
| *C06B 25/00* | (2006.01) |
| *C06B 25/02* | (2006.01) |

(56) References Cited

U.S. PATENT DOCUMENTS

| | | | | |
|---|---|---|---|---|
| 8,608,879 | B1 * | 12/2013 | Sabatini | C06B 33/04 149/61 |
| 9,856,181 | B1 * | 1/2018 | Sabatini | C06B 33/14 |
| 2014/0140938 | A1 * | 5/2014 | Gallis | A01N 59/06 424/49 |

FOREIGN PATENT DOCUMENTS

| | | | |
|---|---|---|---|
| CN | 103319426 | A * | 9/2013 |
| EP | 0154532 | A2 | 9/1985 |
| WO | 2014123508 | A1 | 8/2014 |

OTHER PUBLICATIONS

Damavarapu et al., Barium Salts of Tetrazole Derivatives—Synthesis and Characterization, Jul. 10, 2009, 17 pgs., https://onlinelibrary.wiley.com/action/doSearch?AllField=Barium+Salts+of+Tetrazole+Derivatives+%E2%80%93+Synthesis+and+Characterization&SeriesKey=15214087.

Pagoria et al., Characterization of 2,6Diamino3,5-Dinitropyrazine-1Oxide (LLM105) as an Insensitive High Explosive Material, Apr. 9, 2002, 14 pgs., https://www.researchgate.net/publication/255199604.

Baird et al., High-Pressure, High-Temperature Well Logging, Perforating and Testing, Oilfield Review—Summer 1998, pp. 50-67, 18 pgs., https://www.slb.com/~/media/Files/resources/oilfield_review/ors98/sum98/pgs_50_67.pdf.

Fischer et al., Calcium 5-Nitriminotetrazolate—A Green Replacement for Lead Azide in Priming Charges, Jan. 10, 2011, 15 pgs., Journal of Energetic Materials, 29: 61-74.

Owen Oil Tools, Percussion Boosters, May 2008, 1 pg., https://www.corelab.com/owen/cms/docs/TechCat/det-3050-134A_%20det-3050-134B.pdf.

Pacific Scientific Energetic Materials Co., Part No. S 51-6956-3 and 51-6956-4 CLCP Initiator Oilfield Ordinance Device, Product Data Sheet, 1 pg., https://www.corelab.com/owen/cms/docs/TechCat/psemc/51-6956-3-4%20CLCP%20Initiator.pdf.

Dynaenergetics, Percussion Initiator Dynawell Custom 1.4S, Nov. 12, 2016, 1 pg., https://www.dynaenergetics.com/uploads/files/58f62e22a35ad_C710_det_pi_custom_1_1_4s.pdf.

Dynaenergetics, Percussion Initiator Dynawell NB HNS 1.4S, Nov. 12, 2016, 1 pg., http://www.dynaenergetics.com/uploads/files/5a340a67d6039_C690_det_pi_nb_hns_1_4s.pdf.

Pagoria et al., Synthesis, Scale-up and Characterization of 2,6-Diamino-3,5-dinitropyrazine-1-Oxide(LLM-105), prepared for submittal to the JOWOG 9—Aldermaster, England, Jun. 22-26, 1998, 8 pgs.

Hunting Titan, TCP Energetic Devices, 2013, 1 pg., http://www.hunting-intl.com/media/1962164/EnergeticDevices.pdf.

The State Intellectual Property Office of P. R. China, China Office Action of CN App. No. 201780025618.5, dated May 26, 2020, 8 pgs., English translation 10 pgs.

* cited by examiner

HIGH TEMPERATURE INITIATOR

CROSS-REFERENCE TO RELATED APPLICATIONS

This application claims priority to International Application No. PCT/EP2017/054965 filed Mar. 2, 2018, which claims the benefit of U.S. Provisional Application No. 62/398,587 filed Sep. 23, 2016 and U.S. Provisional Application No. 62/333,760 filed May 9, 2016, which are incorporated herein by reference in their entireties.

FIELD

A method of use and device configured for initiating an explosion, the device configured for high temperature applications for extended periods of time is generally described.

BACKGROUND

Various initiators, such as mechanical initiators (including pressure initiators) and electronic or electric initiators, are currently used in perforating gun assemblies in the oil and gas industry at the beginning of an explosivetrain. The current state of the art percussion initiators use lead azide, silver azide, 2-(5-chlorotetrazolato)-pentaammine cobalt (III) diperchlorate (CLCP) or mixtures thereof, as a primary explosive, which initiates a secondary explosive like Hexanitrostilbene (HNS). This combination of explosive materials are capable of providing effective initation of a perforating gun assembly at temperatures of up to about 260° C. for about 1 to 2 hours if lead azide is used, and up to about 220° C. for about 200 hours when mixtures containing silver azide are used. Unfortunately, as more and more off-shore drilling is being undertaken, wells are getting deeper and hotter, and thus currently available initiators are not capable of withstanding the increased time and temperature requirements.

Not only are current explosive materials incapable of maintaining their explosive effectiveness at high temperatures for extended periods of time, there is a movement to reduce use of such prior primary explosives (particularly lead azide and silver azide) due to their deleterious environmental impacts. Due to the high volatility and high toxicity of these materials, especially during use, they often require workers to take increased precautionary measures to reduce the risk of undesired explosion and exposures during manufacture.

While 2,6-Bis(picrylamino)-3,5-dinitropyridine (PYX) has been successfully used in boosters and detonating cords in prior perforating gun assemblies, (see, for instance, FIG. 5), it was not considered suitable for use in initiators, at least in part because it was considered insensitive to initiation. That is, PYX is known to be quite difficult to initiate as compared to, for instance, HNS and other secondary explosives. Furthermore, while barium 5-nitriminotetrazolate (BAX) is known to have improved thermal stability over prior known explosive materials, it was often considered an unsuitable material for use in initiators.

In view of the disadvantages associated with currently available methods and devices for initiating a perforating gun assembly, there is a need for a device and method that provides a combination of explosive materials for use in an initiator that is capable of withstanding high temperature applications for extended periods of time, without compromising the output and ability to initiate the explosives. Further, there is a need for a device and method that provides a combination of materials for use in an initiator, the combination of materials having reduced risks of explosion and reduced toxicity levels, particularly during manufacture of the initiator.

BRIEF DESCRIPTION

According to an aspect, the present embodiments may be associated with a device and method of using an initiator including a body configured for receiving at least one explosive including barium 5-nitriminotetrazolate (BAX). According to a further aspect, the body of the initiator is configured for receiving at least two layers of explosive. In this embodiment, the layers of explosive include a primary explosive of the barium 5-nitriminotetrazolate (BAX) and a secondary explosive includes 2,6-Bis(picrylamino)-3,5-dinitropyridine (PYX) and/or Hexanitrostilbene (HNS).

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

Figure 1A:
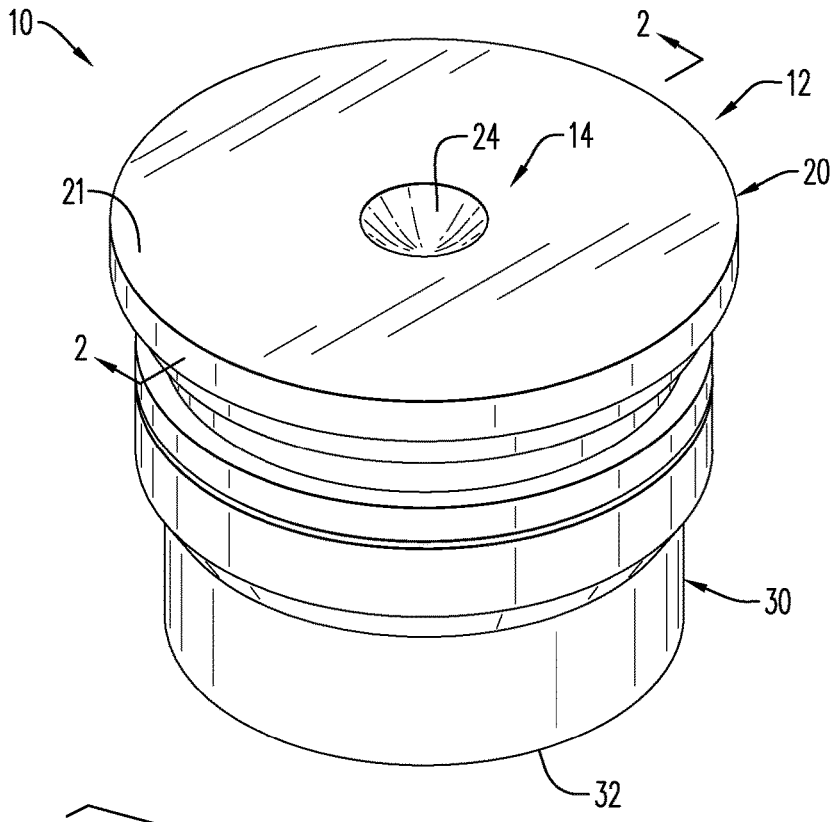
FIG. 1*a* is a perspective view of an assembled percussion initiator according to an embodiment.
Figure 1B:
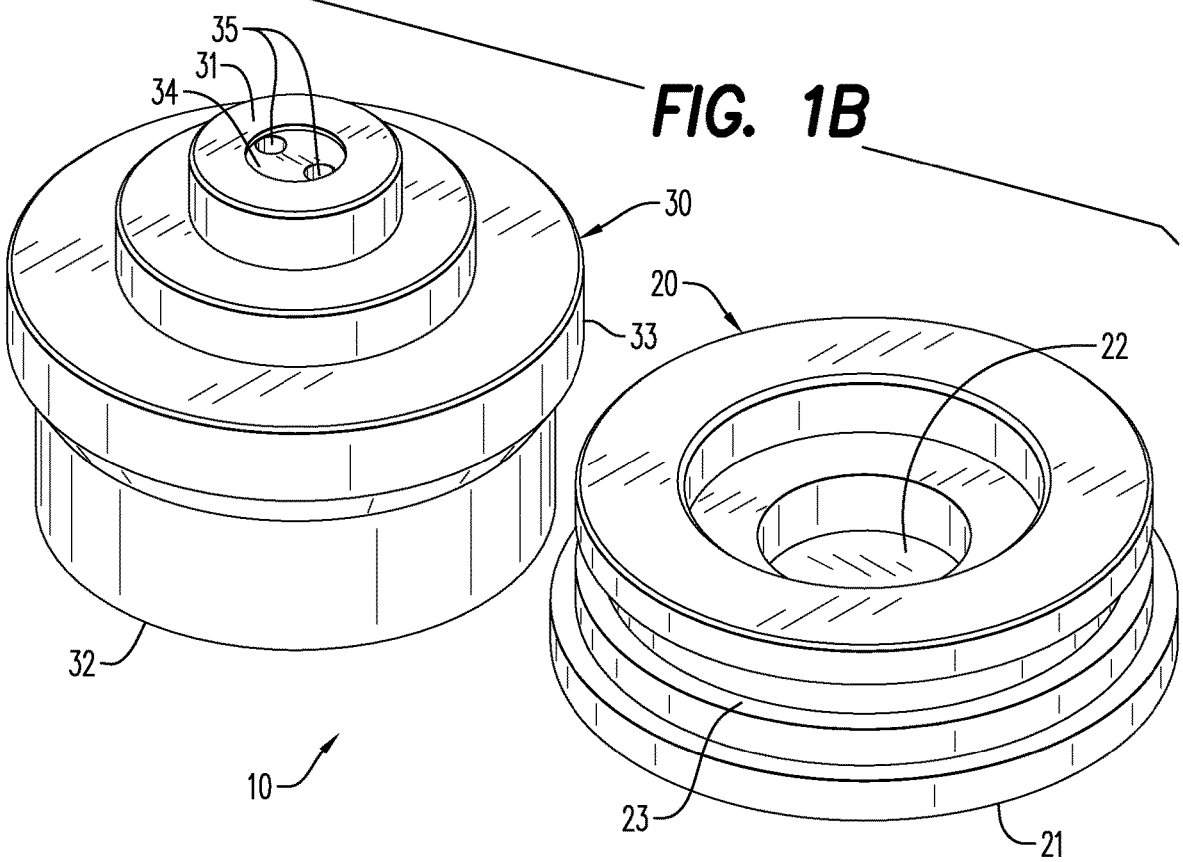
FIG. 1*b* is a perspective view of the percussion initiator of FIG. 1*a*, illustrating the percussion initiator in an unassembled manner.
Figure 2:
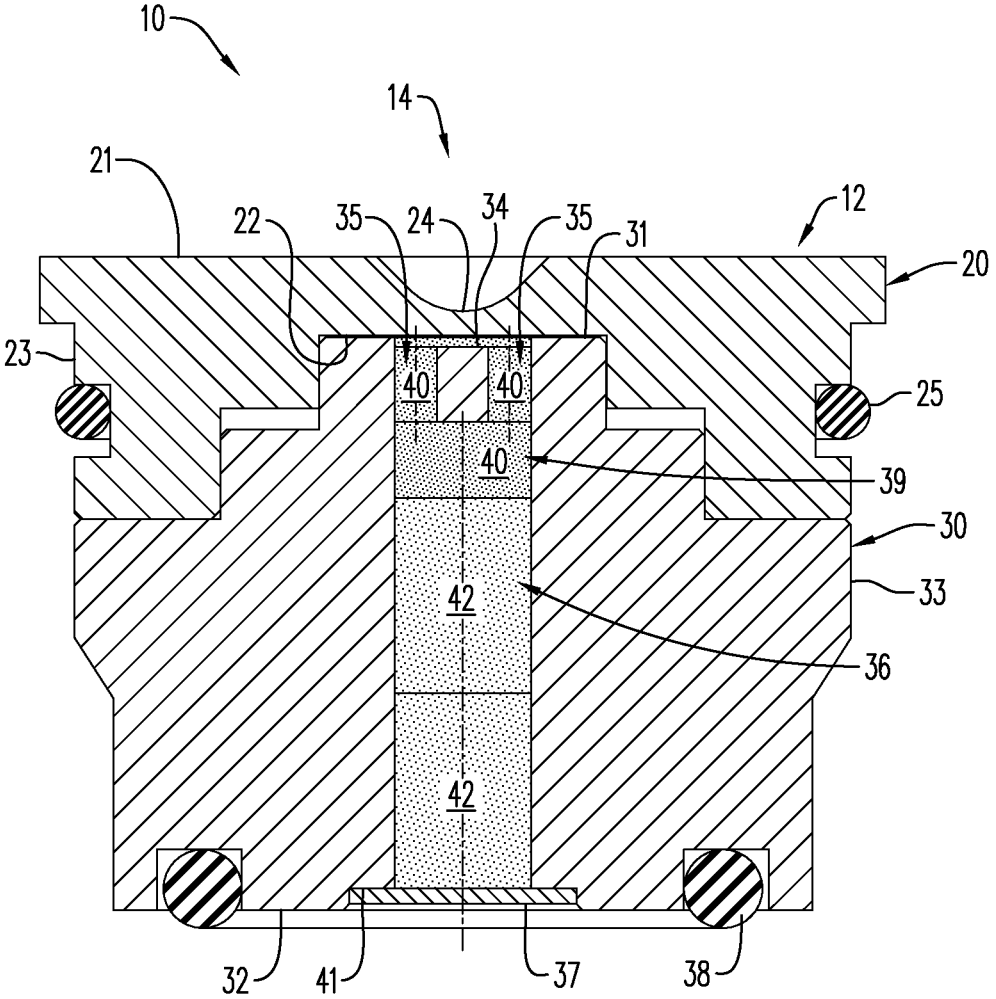
FIG. 2 is a cross-sectional side view of the assembled initiator of FIG. 1*a* according to an embodiment.
Figure 3:
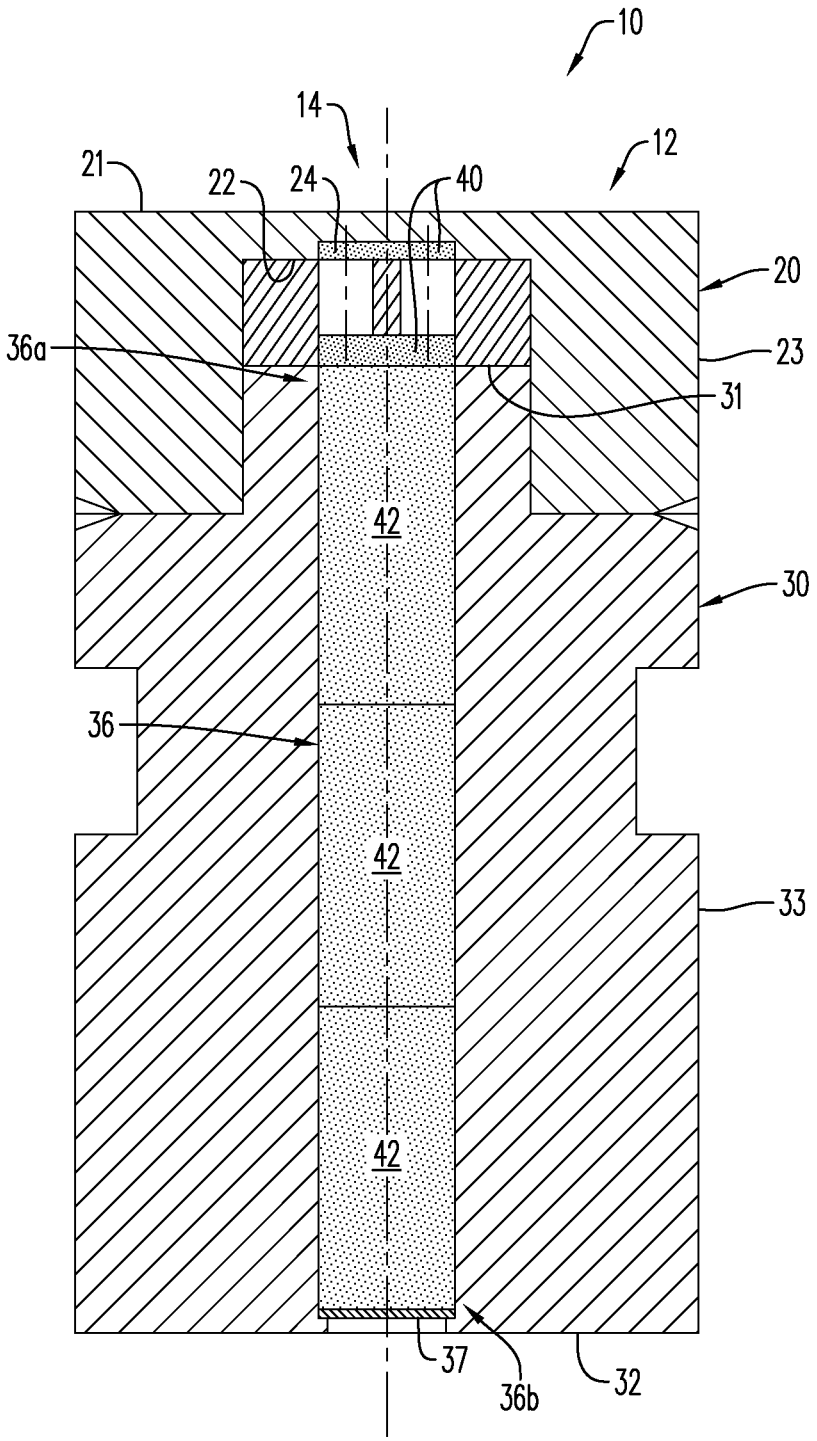
FIG. 3 is a cross-sectional side view of an electronic initiator according to an embodiment.
Figure 4:
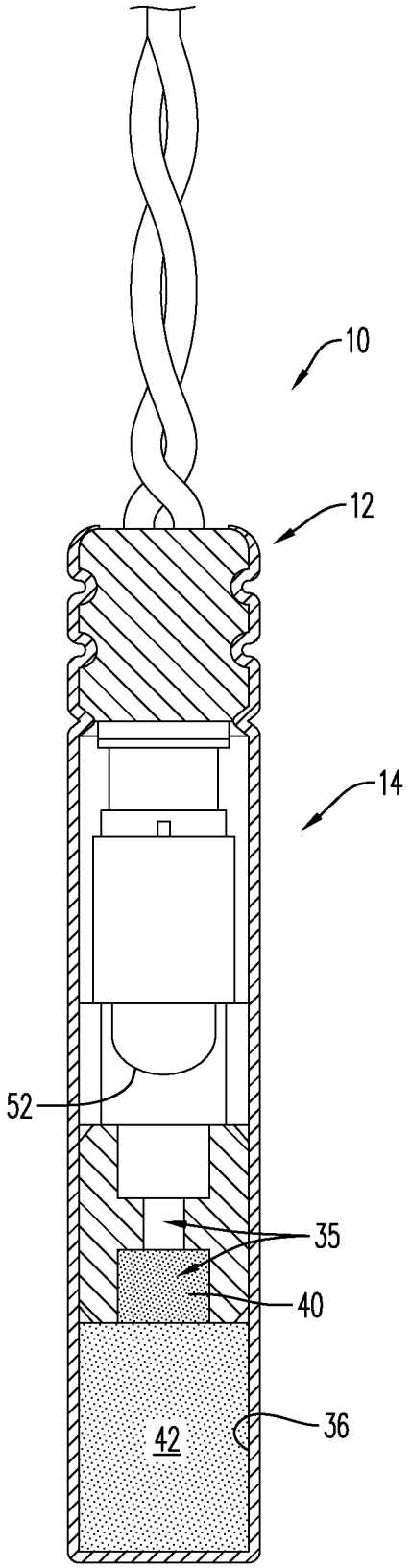
FIG. 4 is a cross-sectional side view of a percussion initiator according to an alternative embodiment.

For purposes of illustrating features of the embodiments, simple examples will now be introduced and referenced throughout the disclosure. Those skilled in the art will recognize that these examples are illustrative and not limiting and are provided purely for explanatory purposes. In the illustrative examples and as seen in FIGS. 1A-4, an initiator 10 is depicted according to an embodiment. In its broadest embodiment, the initiator 10 includes a body 12 configured for receiving at least one explosive including barium 5-nitriminotetrazolate (BAX). According to an aspect and as seen in FIGS. 2-4, the body 12 is configured for receiving at least two layers of explosive. In this embodiment, the layers of explosive include a primary explosive 40 and a secondary explosive 42, and the primary explosive 40 includes barium 5-nitriminotetrazolate (BAX) while the secondary explosive 42 includes 2,6-Bis(picrylamino)-3,5-dinitropyridine (PYX) and/or Hexanitrostilbene (HNS). It is further contemplated that mixtures of the secondary explosive 42 can be used, and in particular, it is possible to mix BAX and PYX for use as the secondary explosive 42, as well as mixtures of PYX and HNS. For instance, the secondary explosive 42 may include mixtures of BAX/PYX or PYX/HNS or BAX/PYX/NHS.

In an embodiment, BAX will be present in the initiator 10 in an amount of about 150-250 mg, or greater than about 150 mg to about 220 mg, or about 200-250 mg, while PYX will be present in an amount of about 240-325 mg, or about 240-300 mg, or about 240 mg-260 mg. Increased amounts of PYX (relative to the amount of BAX) will lead to more output energy, which will provide a more secure performance and slightly better temperature ratings. If HNS is used instead of or as a mixture with PYX, it is believed that similar amounts (i.e., about 240-325 mg total amount of secondary explosive) may be used.

The initiator 10 is particularly advantageous in that it is capable of being subjected to high temperature applications for extended periods of time, without adversely affecting the ability to initiate a detonation (for instance, as found in a perforating gun assembly). According to an aspect, the initiator 10 is able to withstand temperatures of at least as high as about 290° C. for at least about 2 hours, about 250° C. for at least about 100 hours, about 250° C. for at least about 200 hours, about 250° C. for at least about 250 hours, and/or about 300° C. for at least about 1 hour without significantly impacting performance of the initiator.

Figure 7:
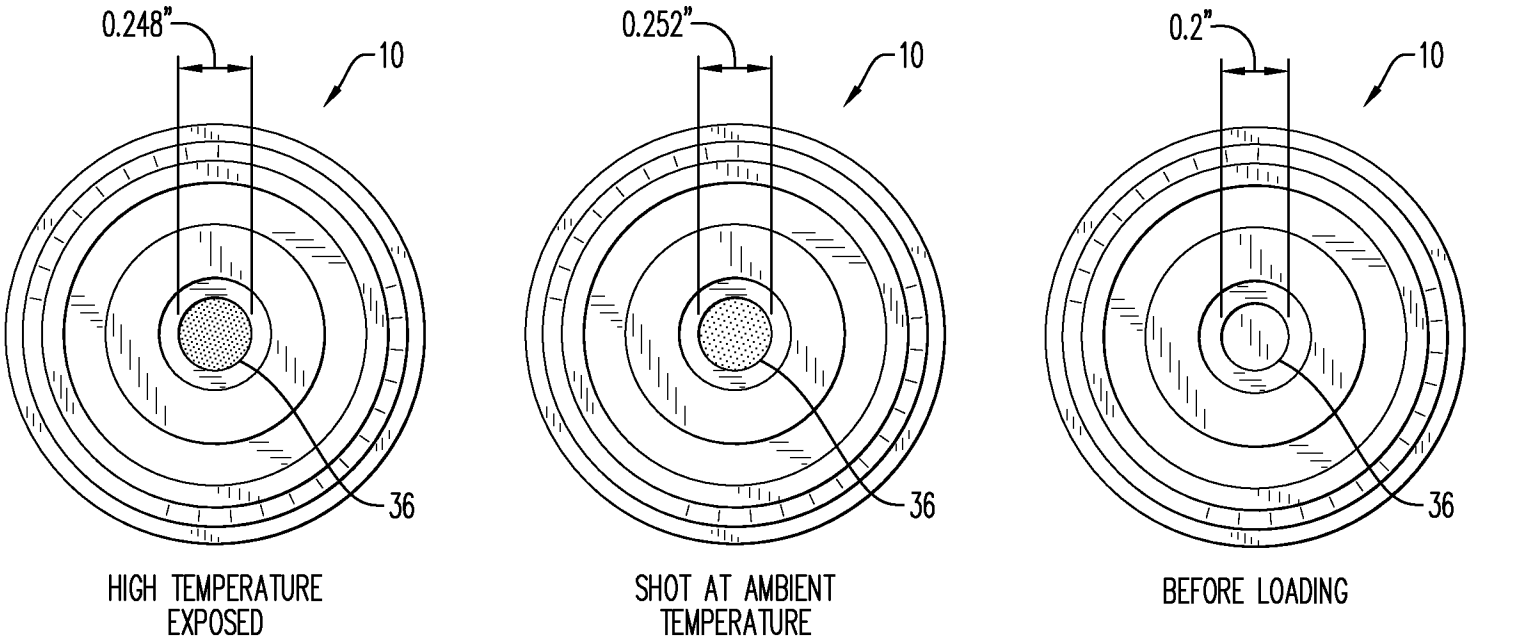
FIG. 7 is an end view of percussion initiators, before and after detonation.

While there are multiple ways to measure the overall performance of an initiator, and as will be discussed in greater detail hereinbelow, one useful parameter is to measure the output bore diameter of a secondary bore 36 (see, for instance, FIG. 7, and as discussed in greater detail hereinbelow), after initiation. Another useful property to ascertain effectiveness of the initiation is to measure the velocity of detonation (VoD) measured in meters/second, that is, the velocity at which the shock wave front travels through a detonated explosive, as would be understood by one of ordinary skill in the art. Thus, a percent reduction (or loss) of VoD can be calculated for each tested time/temperature parameter.

Figure 5A:
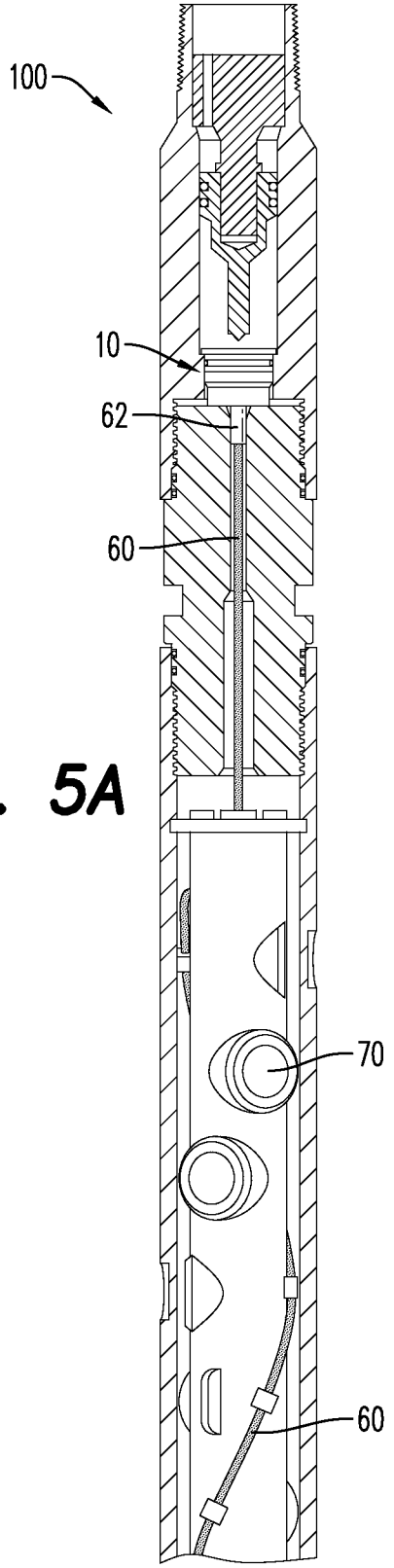
FIG. 5*a* is a partial cross-sectional side view of a tubing conveyed perforating gun assembly including a percussion initiator according to an embodiment.
Figure 5B:
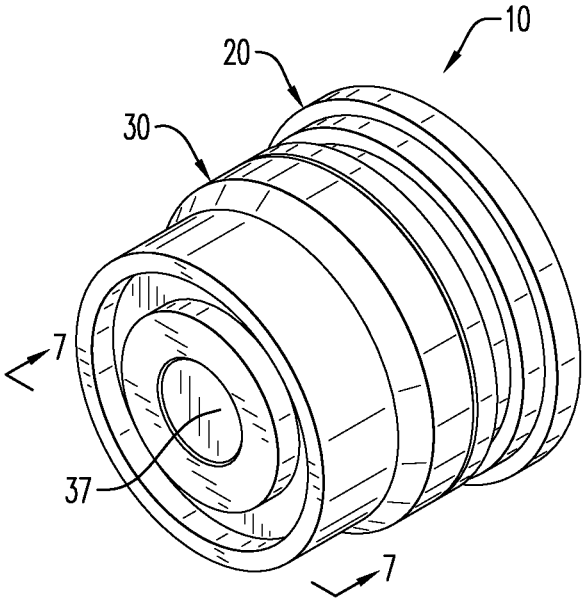
FIG. 5*b* is a perspective view of the percussion initiator used in the tubing conveyed perforating gun assembly of FIG. 5*a* according to an embodiment.
Figure 5C:
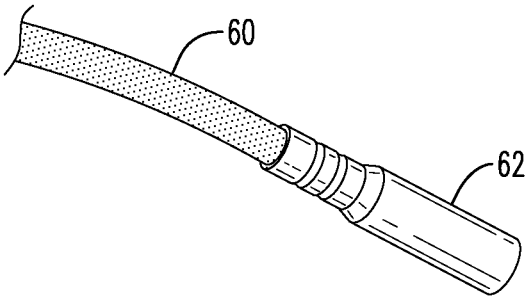
FIG. 5*c* is a perspective view of one end of a detonating cord used in the embodiment of the tubing conveyed perforating gun assembly of FIG. 5*a;*

With particular reference to FIGS. 1A-3 and according to an aspect, the initiator 10 is configured as a percussion initiator and includes a two-part cylindrically-shaped body. An upper body 20 includes an upper surface 21 and a lower surface 22, with the body extending therebetween, and defined by a multi-stepped periphery 23 (FIGS. 1A-2) or an un-stepped (or smooth) periphery 23 (FIG. 3). According to an aspect, the multi-stepped periphery 23 is configured to adapt in size and shape for the particular seating configuration/arrangement needs of a particular perforating gun assembly 100 (FIG. 5). Thus, a sealing member 25 may be positioned along the periphery 23 to seal and/or isolate the initiator 10 from fluids when positioned within the perforating gun assembly 100. As shown herein, the upper surface 20 includes a depression or divot 24 positioned centrally in the upper surface 21 of the upper body 20, and configured for receiving a firing mechanism. The lower surface 22 of the upper body 20 includes also includes a stepped surface, according to an embodiment, with a central portion of the lower surface 22 being positioned opposite to the depression 24 found in the upper surface 21. According to the embodiment depicted in FIG. 3, the upper body 20 provides the depression 24 positioned centrally in the lower surface 22 of the upper body 20. In this embodiment, the depression 24 provides a reduced thickness between the upper surface 21 of the upper body 20 and the lower surface 22 of the upper body 20, but may also provide a recessed area configured to receive an explosive as will be discussed in greater detail hereinbelow.

As seen in FIGS. 1A-3, the lower body 30 also includes an upper surface 31 and a lower surface 32 with the body extending therebetween. As seen for instance in FIG. 2, the lower body 30 may include one or more sealing members 38, such that when placed into the perforating gun assembly 100 (FIG. 5), the sealing member 38, typically working in conjunction with one or more sealing members 25 positioned on the periphery of the upper body 20, isolates the explosive material from fluids found in the perforating gun assembly 100 (FIG. 5).

The lower body 30 includes one or more bores extending through the length of the body 30. With particular reference to FIGS. 1A-2, the lower body 30 includes an upper recessed portion 34 extending centrally within the lower body 30 from the upper surface 31 of the lower body 30 and a lower recessed portion 41 extends centrally within the lower body 30 from the lower surface 32 of the lower body 30. At least two primary bores 35 extend from the recessed portion 34. As shown herein, the two primary bores 35 are spaced equidistantly from a central axis of the lower body 30. A secondary bore 36 extends from the primary bores 35 and is also positioned centrally within the lower body 30. According to an aspect and as shown in FIG. 2, the bore extending below the primary bores 35 may include the secondary bore 36 and an intermediate bore 39. Alternatively, the secondary bore 36 may extend along the entire body of the lower body 30 spanning between the upper surface 31 and the lower surface 32, and yet various layers of explosives may be positioned within various zones of the same bore. (See, for instance, FIG. 3.) In such an embodiment, the bore may include an upper bore portion **36*a* and a lower bore portion 36*b*. With reference again to FIG. 2, the lower recessed portion 41 typically extends from the secondary bore 36 to the lower surface 32 of the lower body 30. Thus, the lower recessed portion 41 extends centrally from the lower surface 32 of the lower body 30 into the lower body 30. As shown in FIG. 2, the lower recessed portion 41 may have a size larger than the secondary bore 32, while it would be understood that the lower recessed portion 41 could have a size smaller than or equal to the secondary bore 32 (see, for instance, FIG. 3**).

According to an aspect, the explosive materials 40, 42 are placed within the bores of the lower body 30, while in an alternative embodiment, the explosive material 40 may also be placed in the depression formed in the lower surface 24 of the upper body 20 as depicted in FIG. 3. Turning again to FIG. 2 and according to an aspect, the primary explosive 40 is placed into the upper recessed portion 34 and the primary bores 35 and the secondary explosive 42 is placed into the secondary bore 36. As shown in this embodiment, the intermediate bore 39, which is of the same diameter as the secondary bore 36, according to one aspect, is filled with the primary explosive 40.

Once the explosive materials 40, 42 are placed within the initiator 10, a flyer disk 37 may be positioned within the lower recessed portion 41 (FIG. 2) or the secondary bore 36 (FIG. 3) to retain the secondary explosive 42 within the secondary bore 36. Since BAX is not hydrophobic, it may be necessary to provide some sort of seal to ensure that the initiator is protected against humidity. According to an aspect, the initiator 10 further includes a high temperature lacquer (not shown) applied to an exterior of the initiator 10 to hermetically seal the initiator 10 against humidity. In an embodiment, the high temperature lacquer is applied to the outer surface of the flyer disk 37 and any exposed portion of the secondary bore 36 to hermetically seal the initiator 10 against humidity. According to an aspect, the flyer disk 37 is coupled to the exterior of the initiator 10 by a welding process, such as, for example, laser welding. The flyer disk 37 may be laser welded within the lower recessed portion 41 or the secondary bore 36, which may help to hermetically seal the initiator against humidity.

As assembled, the initiator 10 includes the upper body 20 attached or connected to the lower body 30, using laser welds (not shown) and the like to seal the bodies together. Thus, as assembled and as seen in FIG. 2, the depression 24 found in the upper surface 21 of the upper body 20 is aligned with the recessed portions 34, 41 and the bores 36, 39 of the lower body 30, thus aligning the primary explosive 40 with the secondary explosive 42, such that mechanical activation applied to the depression 24 transmits the percussive force necessary to initiate the primary explosive 40, which in turn initiates the secondary explosive 42. The similar arrangement can be found in FIG. 3.

According to an aspect, the initiator 10 is initiated by an activator 14 (see, for instance, FIG. 1A), such as an electronic activator and a mechanical activator. Though not shown in detail, as would be understood by one of ordinary skill in the art, when the activator 14 is an electrical activator, typically an electric current is applied to activate a fuse head or a bridge wire 52, (see, for instance, FIG. 4), while when the activator 14 is a mechanical activator, initiation is initiated by a mechanical mechanism such as the percussion devices depicted in FIGS. 2-3. Such percussion devices typically include a firing mechanism (not shown), such as a firing pin, which typically provides a percussion to initiate the explosive. While it is recognized that typical electronic initiators may not be made using fuse heads or bridge wires rated to the current temperature ratings found in the presently presented initiators, such materials are capable of being augmented as would be understood by one of ordinary skill in the art.

According to yet another aspect, a method of using the various initiators 10 described hereinabove is also disclosed. Thus, once the initiator 10 is provided, it may be positioned within the perforating gun assembly 100, such as a tubing-conveyed perforating gun. The perforating gun is positioned into a wellbore, but need not be used right away without compromising the integrity or effectiveness of the initiator. There are a myriad of circumstances that may arise in which a well operator might be required to leave the perforating gun assembly 100 positioned within the wellbore for extended periods of time including foul weather, strikes, or other extenuating circumstances. Thus, the imitator 10 may be subjected to increased temperatures for prolonged periods of time, as set forth in detail hereinabove. When the initiator 10 is subsequently initiated, however, the primary explosive 40 maintains its ability to be initiated, and thus to initiate the secondary explosive 42, without reducing velocity of detonation by more than about 10%.

A method of assembling both an electronic and mechanical initiator 10 that is capable of withstanding high temperatures for extended periods of time without significantly impacting performance of the initiator 10 is also described herein. According to one aspect, the electronic or electric initiator 10 includes the body 12 having a fuse head or bridge wire 52 aligned with a primary bore 35 and a secondary bore 36; the primary explosive 40 is placed into the primary bore 35 and the secondary explosive 42 is placed into the secondary bore 36; the primary explosive 40 is aligned with the secondary explosive 42; the fuse head or bridge wire 52 is positioned in working relationship with the primary explosive 40 such that initiation of the fuse head or bridge wire 52 initiates the primary explosive 40, and the primary explosive 40 initiates the secondary explosive 42.

According to another aspect, the mechanical initiator 10 includes a firing mechanism capable of mechanically activating the initiator 10. In this embodiment, the explosive materials 40, 42 are placed within the recessed portions 34, 41 and/or bores 35, 36, 39; the upper body 20 is connected to the lower body 30 to align the depression 24 formed in the upper body 20 with the one or more explosive materials 40, 42 and configured as described hereinabove; and firing of the firing mechanism into the depression 24 initiates the primary explosive 40, and the primary explosive 40 initiates the secondary explosive 42.

EXAMPLES

Multiple embodiments of the initiator 10 found in FIG. 2 were made wherein approximately 220 mg of the BAX was used as the primary explosive 40 in the two primary bores 35 and the intermediate bore 39, while 240 mg of PYX was used as the secondary explosive 42 in the secondary bore 36. An increased amount of BAX, as compared to prior amounts of lead azide, was used in the examples. Typically, BAX was used in amounts that equal a multiplier of about 3 to about 4 times the amount of lead azide. Since BAX has only a slightly lower density than lead azide, these increased amounts resulted in about 3 to about 4 times more volume (thus widened bore diameters), but use of sufficient amounts of the BAX allowed harnessing of the benefits of thermal stability found in BAX against the increased cost of the material, thus resulting in improved temperature/time stability of the overall initiators as described herein.

As seen in Table 1, the initiators were tested in harsh temperature conditions (at least about 250° C.) at various time intervals, and the output bore diameter (in inches) and the velocity of detonation (in meters/second) were measured. The percent reduction of VoD at each time/temperature parameter was calculated. The average (for multiple initiators) measurements are recorded in Table 1. It was found that the velocity of detonation was not reduced by more than about 20%.

TABLE 1

| Sample | Exposure Conditions | Output Bore Diameter (in.) | VoD (m/sec) | % Reduction |
|---|---|---|---|---|
| 1 | None | 0.2 | N/A | N/A |
| 2 | None/Ambient | 0.252 | 6340 | N/A |
| 3 | 290° C./2 hrs | 0.248 | 6125 | 3.4% |
| 4 | 250° C./100 hrs | 0.244 | 5934 | 6.4% |
| 5 | 250° C./200 hrs | 0.230 | 5890 | 7.1% |
| 6 | 250° C./250 hrs | 0.210 | | |

Figure 6:
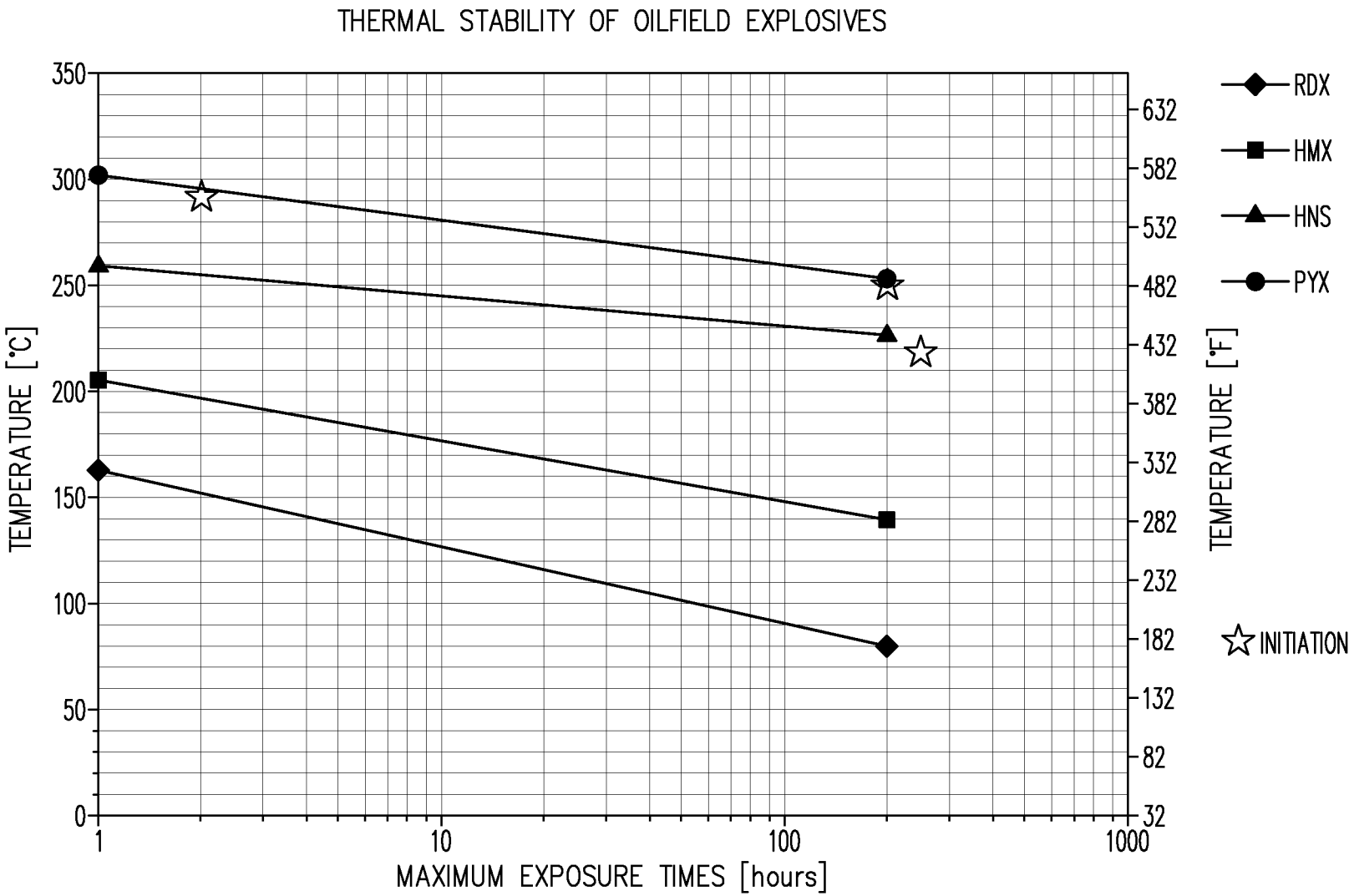
FIG. 6 is graphical representation of typical temperature stability of various primary and secondary explosives used in initiators.

As can be seen in the table, as time increases, the ballistic energy output (shown via diminishing output bore diameter) reduces, such that by example 6, the output (as measured by the output bore diameter) is barely more than the initial bore diameter (0.2 inches vs. 0.210 inches), meaning the usefulness of these initiators at temperatures of 250° C. for 250 hours has at least begun to exceed is effectiveness, while reducing the temperature to 230° C. for 250 hours remained effective. With reference to FIG. 6, a graphical representation of temperature/time stability of the above-tested samples (3, 5 and 7—shown as a star) are overlaid on a typical temperature/time stability chart for various explosive materials of the prior art, showing marked improvement over prior combinations of various primary and secondary explosives currently used in initiators.

Turning again to FIG. 7, end views of the lower surface of three percussion initiators 10 are depicted. As shown herein, a view of an unloaded (pre-filling with explosive material) is depicted on the far right picture, showing the nominal bore diameter of 0.2 inches. After filling each of the initiators as described above in the examples, the middle picture depicts the initiator 10 after having been shot at ambient temperature. As seen above in Table 1, the output bore diameter 36 was measured at 0.252 inches. The far left picture depicts the percussion initiator 10 after being subjected to 290° C. for 2 hours. As seen above in Table 1, the output bore diameter 36 was measured at 0.248 inches. Thus, even though the initiator made as described herein was subjected to unusually high temperatures for an extended period of time, the output bore diameter was minimally impacted, indicating that the output of the initiator was not adversely impacted.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order, orientation or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the method, device and machine, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An initiator, comprising:

a body; and at least one explosive housed in the body, the at least one explosive comprising barium 5-nitriminotetrazolate (BAX).

2. An initiator, comprising:

a body; and at least two layers of explosive housed within the body, wherein a first layer of the at least two layers of explosive comprises a primary explosive and a second layer of the at least two layers of explosive comprises a secondary explosive, the primary explosive comprising barium 5-nitriminotetrazolate (BAX) and the secondary explosive comprising 2,6-Bis(picrylamino)-3,5-dinitropyridine (PYX) and/or Hexanitrostilbene (HNS).

3. The initiator of claim 2, wherein the secondary explosive comprises a combination of BAX and PYX or a combination of PYX and HNS.

4. The initiator of claim 2, wherein the initiator is initiated by an activator comprising one of an electronic activator and a mechanical activator.

5. The initiator of claim 4, wherein the electronic activator comprises a fuse head or a bridge wire, wherein upon activation, the fuse head or bridge wire initiates the primary explosive, and the primary explosive initiates the secondary explosive.

6. The initiator of claim 4, wherein the mechanical activator comprises a percussion device, wherein upon activation and impact of a firing mechanism, the percussion device initiates the primary explosive, and the primary explosive initiates the secondary explosive.

7. The initiator of claim 2, wherein the body comprises a two-part body comprising:

an upper body; and a lower body, wherein the upper body comprises an upper surface and a lower surface, the upper surface comprises a depression positioned centrally in the upper surface of the upper body, and the lower body comprises an upper surface, a lower surface, an upper recessed portion extending centrally within the lower body from the upper surface of the lower body, at least two primary bores extending from the recessed portion, a secondary bore extending from the primary bores and positioned centrally within the lower body, and a lower recessed portion extending from the secondary bore, wherein the lower recessed portion extends centrally from the lower surface of the lower body, within the lower body, such that placement of the primary explosive into the upper recessed portion and the primary bores and placement of the secondary explosive into the secondary bore aligns the primary explosive with the secondary explosive, and connection of the upper body to the lower body aligns the depression formed in the upper body with the primary explosive placed in the lower body.

8. The initiator of claim 7, further comprising a flyer disk positioned within the lower recessed portion, the flyer disk configured to retain the secondary explosive within the secondary bore.

9. The initiator of claim 2, wherein the body comprises a two-part body having an upper body and a lower body, wherein the upper body comprises an upper surface and a lower surface, the lower surface comprises a depression positioned centrally in the lower surface of the upper body, wherein the lower body comprises a secondary bore, and the primary explosive is placed into the depression in the lower surface of the upper body and the secondary explosive is placed into the secondary bore, and the upper body is connected to the lower body to align the primary explosive with the secondary explosive.

10. The initiator of claim 9, further comprising a flyer disk positioned within a lower portion of the secondary bore adjacent to and recessed from the lower surface of the lower body, wherein the flyer disk is configured to retain the secondary explosive within the secondary bore.

11. The initiator of claim 2, wherein the initiator is configured to satisfy one of the following conditions:

(i) withstand temperatures at least as high as about 250° C. for at least about 200 hours without adversely affecting the ability to initiate a detonation; and (ii) withstand temperatures at least as high as about 300° C. for at least about 1 hour, without adversely affecting the ability to initiate a detonation.

12. The initiator of claim 2, further comprising a high temperature lacquer applied to the initiator to hermetically seal the initiator against humidity.

13. The initiator of claim 8, wherein the flyer disk is coupled to the initiator body by a laser welding process.

14. The initiator of claim 8, further comprising a high temperature lacquer applied to the outer surface of the flyer disk and any exposed portion of the secondary bore to hermetically seal the initiator against humidity.

15. A method of assembling an electronic or electric initiator capable of withstanding temperatures at least as high as about 250° C. for at least about 200 hours without significantly impacting performance of the initiator or temperatures at least as high as about 300° C. for at least about 1 hour without significantly impacting performance of the initiator, the method comprising:

providing a body comprising a fuse head or bridge wire aligned with a primary bore and a secondary bore;

placing a primary explosive comprising barium 5-nitriminotetrazolate (BAX) into the primary bore;

placing a secondary explosive comprising 2,6-Bis(picrylamino)-3,5-dinitropyridine (PYX) into the secondary bore;

aligning the primary explosive with the secondary explosive;

positioning the fuse head or bridge wire in working relationship with the primary explosive such that initiation of the fuse head or bridge wire initiates the primary explosive, and the primary explosive initiates the secondary explosive.

16. The initiator of claim 1, wherein the initiator is initiated by an activator comprising one of an electronic activator and a mechanical activator.

17. The initiator of claim 16, wherein the electronic activator comprises a fuse head or a bridge wire, wherein upon activation, the fuse head or bridge wire initiates the primary explosive, and the primary explosive initiates the secondary explosive.

18. The initiator of claim 16, wherein the mechanical activator comprises a percussion device, wherein upon activation and impact of a firing mechanism, the percussion device initiates the primary explosive, and the primary explosive initiates the secondary explosive.

19. The initiator of claim 1, wherein the initiator is configured to satisfy one of the following conditions:

(i) withstand temperatures as high as about 250° C. for at least about 200 hours, without adversely affecting the ability to initiate a detonation; and (ii) withstand temperatures at least as high as about 300° C. for at least about 1 hour, without adversely affecting the ability to initiate a detonation.

20. The initiator of claim 1, wherein the body comprises a two-part body including an upper body and a lower body, wherein the upper body comprises an upper surface and a lower surface, the lower surface comprising a depression positioned centrally in the lower surface of the upper body, wherein the at least one explosive comprising barium 5-nitriminotetrazolate (BAX) is placed into the depression in the lower surface of the upper body, and the lower body comprises a secondary bore configured to receive a secondary explosive, and the upper body is connected to the lower body to align the at least one explosive with the secondary explosive.

* * * * *